US006489875B1

(12) United States Patent
Uchikoba et al.

(10) Patent No.: US 6,489,875 B1
(45) Date of Patent: Dec. 3, 2002

(54) MULTI-LAYER FERRITE CHIP INDUCTOR ARRAY AND MANUFACTURING METHOD THEREOF

(75) Inventors: Fumio Uchikoba, Tokyo (JP); Tomoyuki Tatemori, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/611,212

(22) Filed: Jul. 6, 2000

(30) Foreign Application Priority Data

Jul. 7, 1999 (JP) ..... 11-192679

(51) Int. Cl.[7] ..... H01F 5/00
(52) U.S. Cl. ..... 336/200; 336/83; 336/192
(58) Field of Search ..... 336/180, 192, 336/199, 200, 65, 83

(56) References Cited

U.S. PATENT DOCUMENTS 5,304,967 A * 4/1994 Hayashi ..... 333/206

FOREIGN PATENT DOCUMENTS

| | | | |
|---|---|---|---|
| JP | 62-24923 | | 5/1987 |
| JP | 2-44309 | | 3/1990 |
| JP | 4-93115 | | 8/1992 |
| JP | 5-291076 | * | 11/1993 |
| JP | 5-326270 | | 12/1993 |
| JP | 5-326271 | | 12/1993 |
| JP | 5-326272 | | 12/1993 |
| JP | 6-338414 | | 12/1994 |
| JP | 7-22243 | | 1/1995 |
| JP | 8-250333 | | 9/1996 |
| JP | 8-264320 | | 10/1996 |
| JP | 8-306541 | | 11/1996 |
| JP | 10-92691 | * | 4/1998 |
| JP | 11-26241 | | 1/1999 |
| JP | 11-162737 | * | 6/1999 |
| JP | 2000182835 A | * | 6/2000 |

OTHER PUBLICATIONS

Nikkei Electronics, No. 740, (Apr. 5, 1999), pp. 181–193.

* cited by examiner

*Primary Examiner*—Lincoln Donovan
*Assistant Examiner*—Tuyen T. Nguyen
(74) *Attorney, Agent, or Firm*—Oblon, Spivak, McClelland, Maier & Neustadt, P.C.

(57) ABSTRACT

A multi-layer ferrite chip inductor array, wherein an element main body 11 is composed by laminating a ferrite layer and a conductor layer in such a manner that the laminated face thereof is vertical with an element mounting surface 15, a plurality of coil shaped internal conductors are furnished within the element main body 11, the coiling direction of said coil shaped internal conductor being parallel with the element mounting surface, and the ferrite sheets formed with through-holes are printed with a plurality of coil shaped internal conductors and conductor patterns with the electrically conductive material, and the ferrite sheets are laminated such that the laminated face thereof is vertical with the element mounting surface. This realization of the invention depends on the production method having the process enabling to obtain the laminated body where the plurality of coil shaped internal conductors are formed, the coiling direction of said conductors being parallel with said element mounting surface.

2 Claims, 6 Drawing Sheets

MULTI-LAYER FERRITE CHIP INDUCTOR ARRAY AND MANUFACTURING METHOD THEREOF

BACKGROUND OF THE INVENTION

The present invention relates to a multi-layer ferrite chip inductor array which is a surface mounted part, and a manufacturing method thereof.

In electronic machines, being small-sized is always demanded in the market, and parts to be used thereto are similarly demanded to be small-sized. Parts such as inductors or capacitors have originally been furnished with leads, and by applying a laminating method, they have been enabled to bake ceramics and metals together, and a monolithic structure furnished with internal conductors has been put in practice. Thereby, it has been possible to make an element itself small-sized, from which lead wires have been cancelled to turn out surface mounted type parts, and which has succeeded in reducing the occupying areas by those parts.

Nowadays, in chip capacitors or chip resistors, the specification of a 1005 shape (length: 1.0 mm, width: 0.5 mm and height: 0.5 mm) is going to be general, and demands for array mounting a plurality of such elements are increasing. On the other hand, the chip inductor has a disadvantageous phase in making small-sized for forming complicated shapes such as coil shaped internal conductors within ferrite elements. Therefore, comparing with capacitors or resistors, the response to small-sizing demands has been delayed. But, such demand is also large in this field, and at present, a 1608 shape (length: 1.6 mm, width: 0.88 mm and height: 0.8 mm) has become general. As to the chip inductor, as a proposal for attempting to realize high characteristics, for example, if providing a structure where a coiling direction of an internal conductor faces toward a vertical direction with respect to terminal electrodes, a self resonance frequency may be heightened (Unexamined Japanese Utility Model Publications 2-44309(U), JP-A-4-93115(U), and Nikkei Electronics, Apr. 5, 1999 (No.740), pp. 181 to 192).

In designing circuits, there often occur cases a plurality of chip inductors have to be mounted on a circuit board, and a space on the board is much occupied, resulting to invite disadvantage for realizing high integration. Therefore, as disclosed in Post-Examined Japanese Patent Publication 62-24923, a chip inductor array was proposed which carried a plurality of internal conductors in a one chip, but the chip inductor array has particular problems such as cross talk or deterioration of insulation resistance which were not found in a single product of the chip inductor. Miniaturization has recently progressed also in the chip inductor array, and demand has raised for arrays of four (4) circuits carried-therein of 3216 shape (length: 3.2 mm , width: 1.6 mm and height: 1.6 mm). Many proposals have been made for solving problems accompanied with matters particular to arrays or miniaturization.

For example, Unexamined Japanese Patent Publications 5-326270, 5-326271 and 5-326272 disclose that, in the chip inductor array, consideration be paid to arrangement of adjacent internal conductors for obtaining higher inductance with a smaller-sized chip. Further, Unexamined Japanese Patent Publications 6-338414, 7-22243, 8-250333 and 8-264320 show methods for improving cross talk which is mutual action between circuits of the chip inductor array in that a straight internal conductor is shaped in coil or a space between adjacent internal conductors or disposal thereof are considered.

As the manufacturing method of the chip inductor array, a lamination method or an extrusion method are known. Unexamined Japanese Patent Publication 8-306541 describes a production method of the chip inductor array by the extrusion method where a plurality of coil shaped conductors are disposed in parallel at the interior of a magnetic core. But the extrusion method is suited to the chip inductor array of relatively large size, and a lamination method is much employed to the chip inductor array of small size.

A general lamination method will be explained with reference to the process chart of FIG. 7.

A 1st process mixes ferrite powder together with a binder and an organic solvent to make a slurry.

A 2nd process coats the slurry on a film such as PET by a doctor blade method and dries it to form a ferrite sheet.

A 3rd process forms through-holes at predetermined positions of the ferrite sheet by a machining work, a laser beam machining or others.

A 4th process carries out a screen process printing of the internal conductor patterns on the ferrite sheets formed with the through-holes, using a conductor paste containing metal powders as silver so as to provide conductor patterns. The through-holes are at this time filled with the conductor paste.

A 5th process laminates the ferrite sheets formed with the internal conductor patterns in a predetermined order. The internal conductor patterns printed on the respective ferrite sheets are then electrically connected with terminal electrodes by the conductors filled in the through-holes and are shaped in coil.

A 6th process heats and presses the laminated ferrite sheets.

A 7th process cuts the heated and pressed laminated ferrite sheets into arbitrary sizes to form chip shapes.

An 8th process heats the chips and removes the binder.

A 9th process bakes and sinters the chips having removed the binder.

A 10th process grinds the above baked chips by a method such as a barrel.

An 11th process forms the terminal electrodes of the predetermined number with the conductor paste such as silver by the screen process printing or roller transcription, and performs the baking treatment thereon, said terminal electrodes being arranged in opposition to the vertical face with respect to the element mounted surface on the chips. The terminal electrode is electrically connected with the terminal electrodes by the conductor extending a starting terminal and an ending terminal of the coil shaped internal conductor.

An 12th process carries out the film treatment on the terminal electrodes by, for example, an electrolytic plating.

Passing through the above processes, the chip inductor carrying the coil shaped internal conductors in the magnetic body is obtained. A plurality of coil shaped internal conductors are housed in the magnetic body to turn out the multi-layer ferrite chip inductor arrays as shown in FIG. 6. Further, Unexamined Japanese Patent Publication 11-26241 shows the chip inductor arrays where the coiling direction of the coil shaped internal conductor is parallel with the mounting surface. In this disclosed chip inductor, the terminal electrode is fabricated with the conductor sheet, and the conductor between the respective terminals is removed for insulation.

However, for forming the multi-layer ferrite chip inductor array of the 2010 Type (length: 2.0 mm and width: 1.0 mm)

where the miniaturization has been advanced, there are problems that the only prior art cannot solve as follows.

First, the conventional terminal electrode was formed by baking the coil shaped internal conductor and the ferrite layer, performing the screen process printing or the roller transcription, and further baking. In this case, since the printing or the transcription is directly done to the ferrite sintered body, it is difficult to set the printing or transcribing precision within predetermined designing values, and since the smaller the shape of the chip inductor array, the smaller the space between the adjacent terminal electrodes, the formation is more difficult. When fabricating the terminal electrode by the conductor sheet, a further process is required for removing conductors between the electrodes.

Second, since the shape of the chip inductor array element is small, when obtaining the inductance of the equal size to the conventional one, if other designs are the same, the spaces between circuits of the coil shaped internal conductors are inevitably narrow. Then, cross talk between circuits is large and is a big obstacle to miniaturization of shapes.

Third, the internal conductors occupying the chip inductor array element and the volume rate of the through-holes are relatively large, so that non-uniform stress is caused in the ferrite structure having the conventional structure of the elements. By effecting stress, the permeability p of the ferrite sintered body is largely varied. In the laminated inductor elements, residual stress occurs by simultaneously baking the internal conductors composed of the electrically conductive material containing silver or terminal electrodes and the ferrite layer, resulting to invite lowering of an apparent $\mu$. This $\mu$ lowering is eased by heat shock when soldering products on the circuit board, and becomes an unstable factor of a characteristic such as fluctuation of impedance. When the element shape is small, the volume rate of the conductor occupying the element increases, and this problem is serious.

Fourth, in parts based on a premise of soldering as the chip inductor array, the electrolytic plating is necessary for making the soldering easy. However, an interface between the conductor containing such as silver and the ferrite layer is easy to generate the residual stress and often causes partial peeling, and so the plating liquid easily goes into this interface. In particular, if it penetrates until the layer of the coil shaped internal conductor, the characteristic is largely changed. As to the printing pattern of the conductor, a limit exists in making lines narrow, and taking the electric resistance into consideration, a width of about 60 $\mu$m is a limit of the designing value, and therefore, the smaller the element shape, the more inevitably increased the volume rate of the conductor occupying the element, and the residual stress generated around the interface becomes large. Thus, if the element shape is small, the peeling easily occurs at the interface between the conductor and the ferrite layer, and the plating liquid easily goes into the interior of the element.

Fifth, since the chip inductor array carries the plurality of internal conductors therein, differently from the chip inductor, it has a problem of deterioration of insulating resistance. When the element shape is small, since the space between the circuits of the internal conductors is still narrower, this problem is more serious.

SUMMARY OF THE INVENTION

The invention has been realized for solving problems involved with the prior art. Accordingly, the problem that the invention is to solve is to provide the small sized multi-layer ferrite chip inductor array of highly sizing precision and high characteristics as well as a production method thereof. More particularly, the terminal electrode is fabricated with high precision, enabling to check influences by stress of the ferrite layer and by the plating treatment, with less cross talk, high self resonance frequency, little deterioration of insulating resistance.

The above mentioned problems can be solved by the structure as follows.

A multi-layer ferrite chip inductor array, wherein an element main body is composed by laminating a ferrite layer and a conductor layer in such a manner that the laminated face thereof is vertical with an element mounting surface, a plurality of coil shaped internal conductors are furnished within the element main body, the coiling direction of said coil shaped internal conductor being parallel with the element mounting surface, and both terminals of said coil shaped internal conductors are electrically connected with terminal electrodes by means of conductors filled in through-holes.

The multi-layer ferrite chip inductor array as set forth in the above, wherein the terminal electrode comprises an electric conductor containing glass frit 10 wt % to 30 wt %.

A method for making multi-layer ferrite chip inductor arrays, comprises a step of forming ferrite sheets containing ferrite material; a step of forming a plurality of through-holes at predetermined positions of the ferrite sheets; a printing step of forming a plurality of coil shaped internal conductors with a conductor material and conductor patterns of terminal electrodes with the same in the ferrite sheets formed with the through-holes, and filling the conductor materials in the through-holes; and a step of laminating the ferrite sheets after the printing step in such a manner that the laminated layer is vertical with respect to the element mounting surface, and obtaining the laminated bodies formed with a plurality coil shaped inside conductors coiling toward a parallel direction with the element mounting face, the coiling direction of said coil shaped internal conductor being parallel with the element mounting surface.

The method for making multi-layer ferrite chip inductor arrays as set forth in the above, wherein the conductor pattern of the terminal conductor is, prior to the baking step, formed in the ferrite sheet by a screen process printing.

The method for making multi-layer ferrite chip inductor array as set forth in the above, wherein both terminals of said coil shaped internal conductors are electrically connected with terminal electrodes by means of conductors filled in through-holes.

The method for making multi-layer ferrite chip inductor array as set forth in the above, wherein the conductor pattern of the terminal electrode is printed with the electric conductor material containing glass frit 10 wt % to 30 wt %.

DETAILED DESCRIPTION OF THE PREFERRED EMBODIMENTS

Explanation will be made to practiced embodiments of the invention with reference to the drawings.

Figure 1:
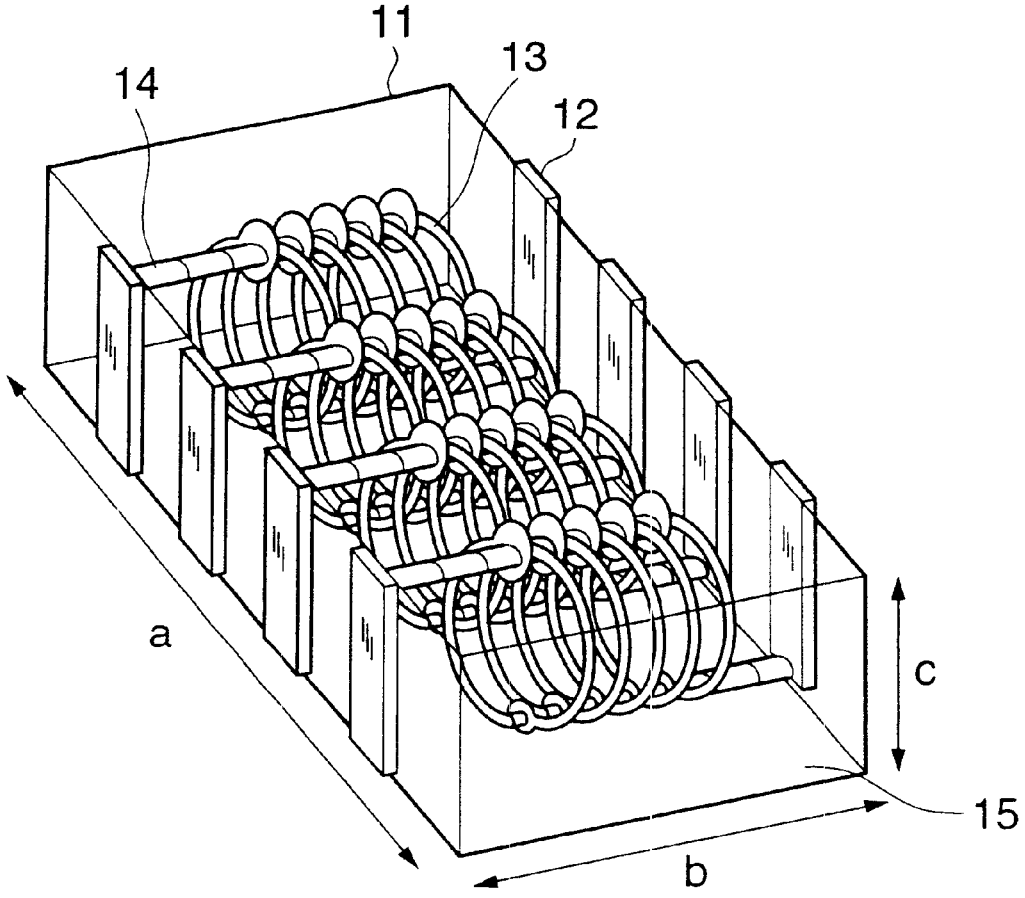
FIG. 1 is a perspective view schematically showing one embodied example of the multi-layer ferrite chip inductor array of the invention.
Figure 3:
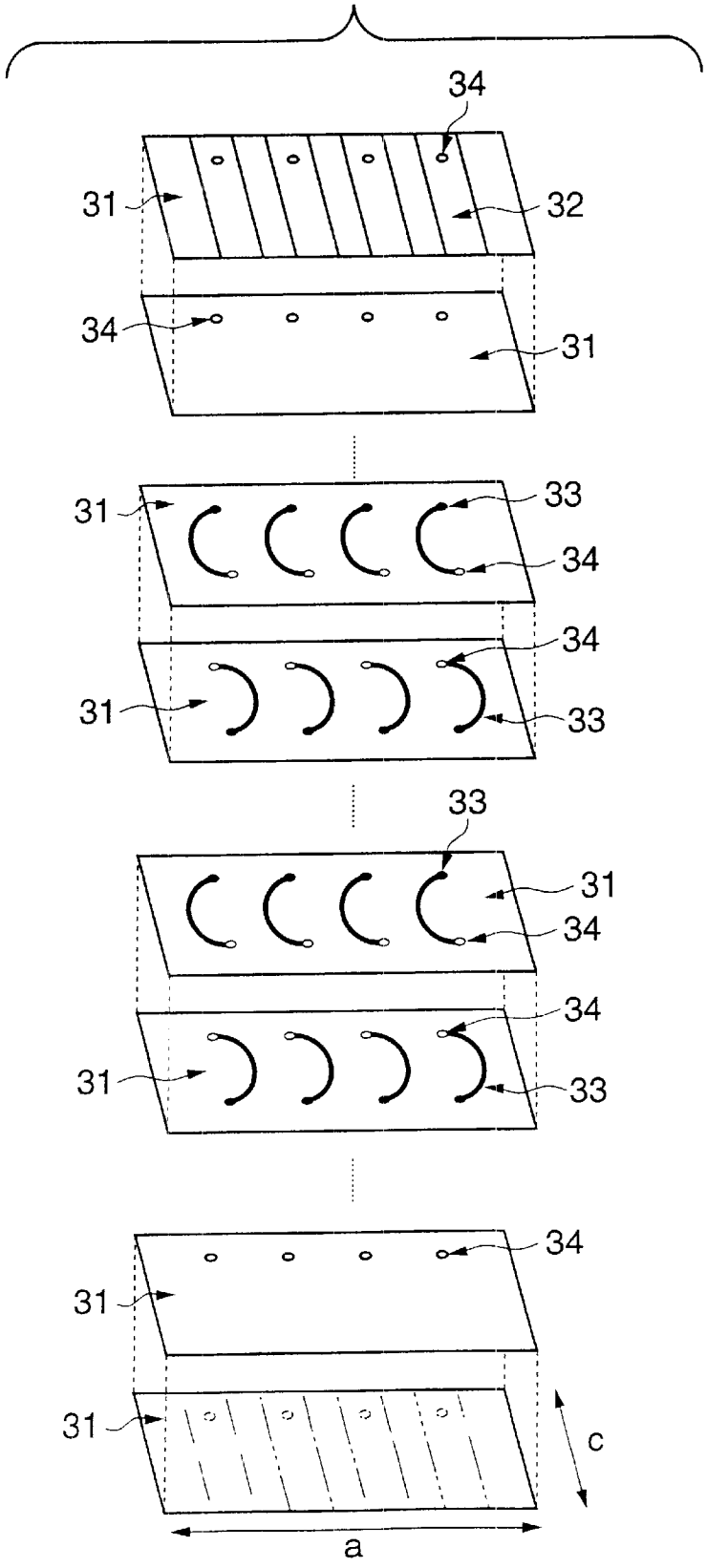
FIG. 3 is a perspective view for explaining the production processing view of the multi-layer ferrite chip inductors of the invention.

The structure of the multi-layer ferrite chip inductors of the invention will be explained, referring to FIGS. 1 and 3. FIG. 1 is a perspective view schematically showing one embodied example of the multi-layer ferrite chip inductor array of the invention. FIG. 3 is a perspective view for explaining a producing process of the multi-layer ferrite chip inductor array of the invention.

The element main body 11 of the multi-layer ferrite chip inductor array concerning one embodiment of the invention is rectangular parallelepiped of length direction a, width direction b and height direction c, and there are laminated the ferrite layer composed of the ferrite sheets and the conductor layer forming the internal conductor and the terminal electrode. In FIG. 1, when the element body is mounted on the circuit board of an electronic machine, an element mounting surface 15 which contacts the board is a bottom face of the element body, and a surface opposite to this face may be an element mounting surface. Depending on the structure of the circuit board, other faces may be contacted to the board, and in the invention, the bottom face of the rectangular parallelepiped shape or the surface opposite to this bottom face shall be called as the element mounting surface.

At the interior of the element body, there are arrays of four (4) circuits of the coil shaped internal conductors 13, the coiling direction of said conductor being parallel with the element mounting surface 15. The internal conductor 13 shown in FIG. 1 is shaped in coils by laminating ferrite sheets. As can be seen in FIG. 3, ferrite sheets 31 printed with coil shaped internal conductor patterns 33 are laminated in a direction vertical (the b direction in FIG. 1) with the face to be the element mounting surface after mounting and by electrically connecting to the terminal electrode via the conductor filled in the through-hole 34 on the ferrite sheet. In FIG. 1, the number of the coil shaped internal conductors is the four circuits, and may be changed depending on sizes of the elements or in response to required characteristics. The coiling number (number of turn) of the coil shaped internal conductor may be changed by altering the laminating number in response to required characteristics. At the outside, four couples of terminal electrodes 12 are formed in the direction at the respectively opposite positions to faces vertical with the b direction. With respect to one opposite couple of terminal electrodes, as shown in FIG. 3, there are, in the predetermined order, laminated the ferrite sheets 31 printed with the terminal electrode patterns 32 and the ferrite sheets 31 printed with the coils shaped internal conductors 33, and both terminals of one coil shaped internal conductor are electrically connected with the terminal electrodes by the conductors filled in through-holes formed in the ferrite sheet 31. In FIG. 1, the number of the terminal electrodes is the four couples, and may be appropriately changed in response to the number of the coil shaped internal conductors 13.

Figure 6:
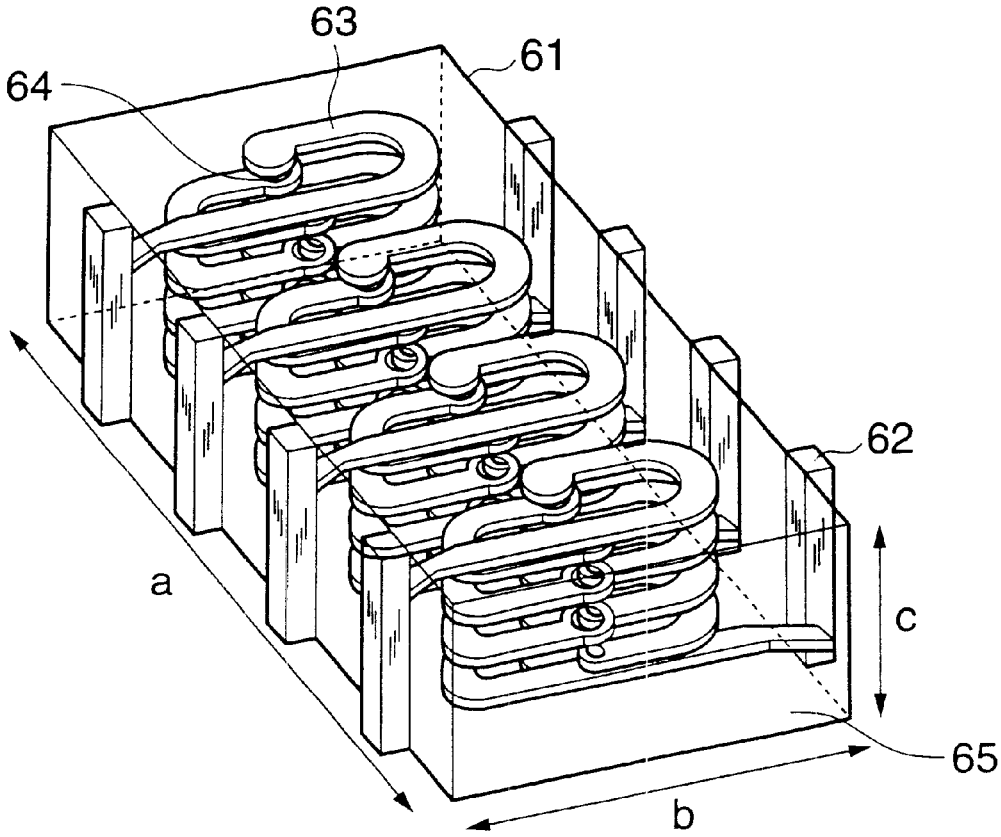
BACKGROUND ART FIG.6
FIG. 6 is a perspective view schematically showing one embodied example of the multi-layer ferrite chip inductor array of the prior art.
Figure 7:
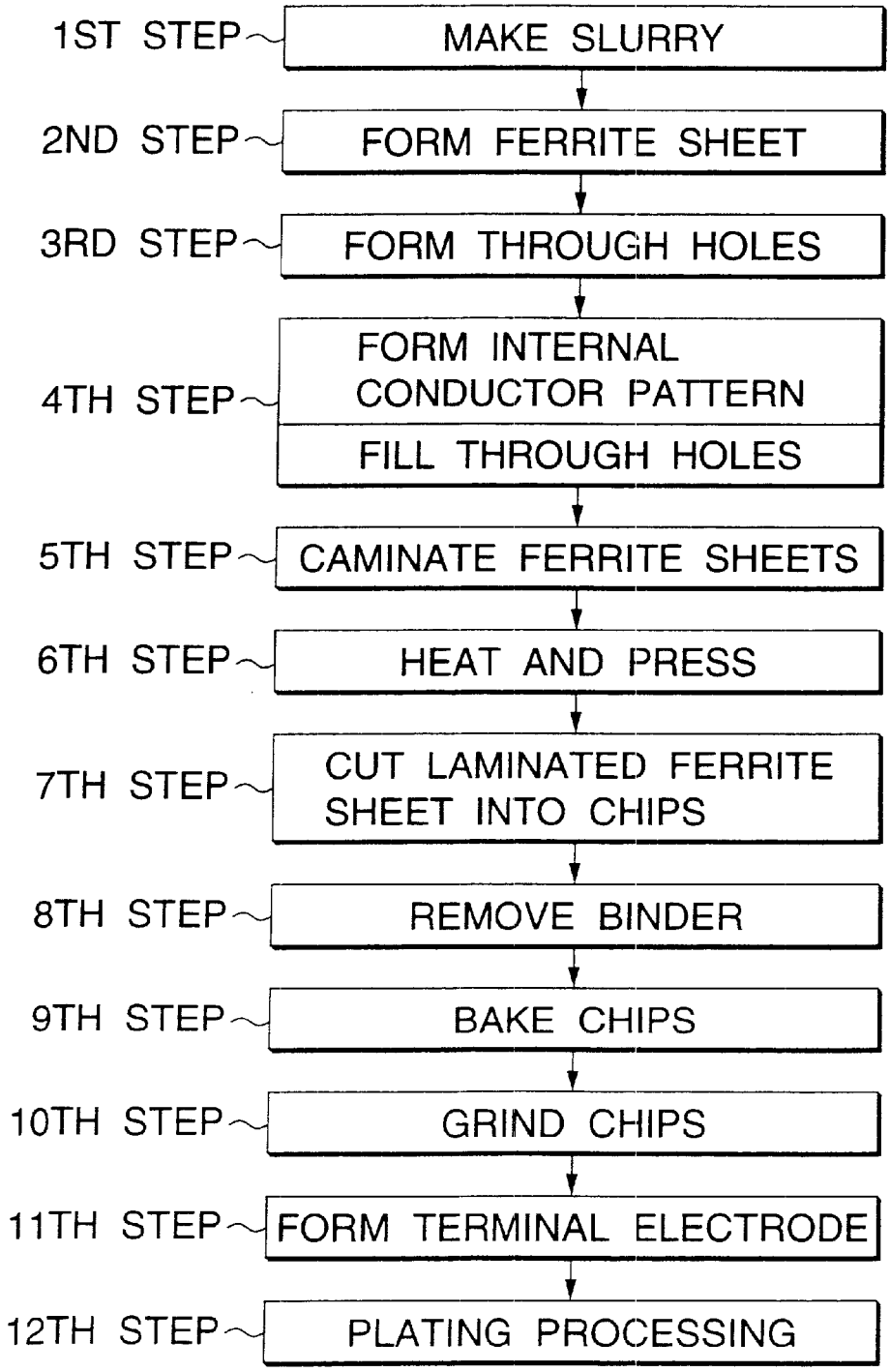
FIG. 7 is a production processing view of the multi-layer ferrite chip inductors of the prior art.

As mentioned above, in the structure of the multi-layer ferrite chip inductor array of the invention, since the positional relation between the coiling direction of the coil shaped internal conductor 13 and the terminal electrode 12 is vertical, stress acting on the ferrite layer from the conductor 13 and stress acting on the ferrite layer from the terminal electrode 12 are parallel. In contrast, in the structure of the conventional multi-layer ferrite chip inductor array shown in FIG. 6, since the positional relation between the coiling direction of the coil shaped internal conductor 63 and the terminal electrode 62 is parallel, stress acting on the ferrite layer from the conductor 63 and stress acting on the ferrite layer from the terminal electrode 62 are vertical. In the stress distribution in the ferrite layer, the conventional structure is more complicated than the inventive structure. Accordingly, the inventive structure can moderate the stress acting on the ferrite layer in comparison with the conventional one. Further, the complication of the stress distribution makes one cause for the plating liquid to invade in the interface between the ferrite layer and the conductor layer, and therefore, depending on the structure of the invention, the plating liquid can be prevented in comparison with the prior art.

In the chip parts, demanding for reliability when mounting them on the circuit board and lowering the height of the element, the size in the height c of the element is often smaller than the length a and the width b, and generally in the 2010 shape (length: 2.0 mm and width: 1.0 mm), the size in the height c is mainly 0.5 mm . Therefore, if the coiling direction of the conductor 13 is parallel with the element mounting surface 15 as the invention, since the coiling is directed in the b direction, the coiling number may be increased if being of the same shape, in comparison with the structure of the coiling direction in the c direction as the prior art, so that a cross sectional area of the coil may be made small by such amount. That the cross sectional area of the coil may be made small, can control the cross talk to be small and is effective for preventing the insulating resistance from deterioration, if the space between the coils is equal to that of the prior art.

Since the terminal electrode 12 and the coil shaped internal conductor 13 are connected by the conductor filled with the metal powder in the through-hole, the connected part may be made near a circular column. Therefore, comparing with the connected part composed of the rectangular conductor extending a starting terminal and an ending terminal of the coil shaped internal conductor 63 as the prior art, the plating liquid can be prevented from invasion from the connected part, enabling to avoid deterioration of characteristics.

Since desirably the tension strength of the terminal electrode 12 is large, it is preferable that the conductor contains 10 wt % or more silicic acid lead based glass frit or silicic acid zinc based glass frit. But too much containing the glass frit, direct current resistance increases and affects bad influence to the characteristic, and therefore preferable is 30 wt % or higher and more preferable is the conductor containing the glass frit of 20 to 25 wt %.

Figure 2:
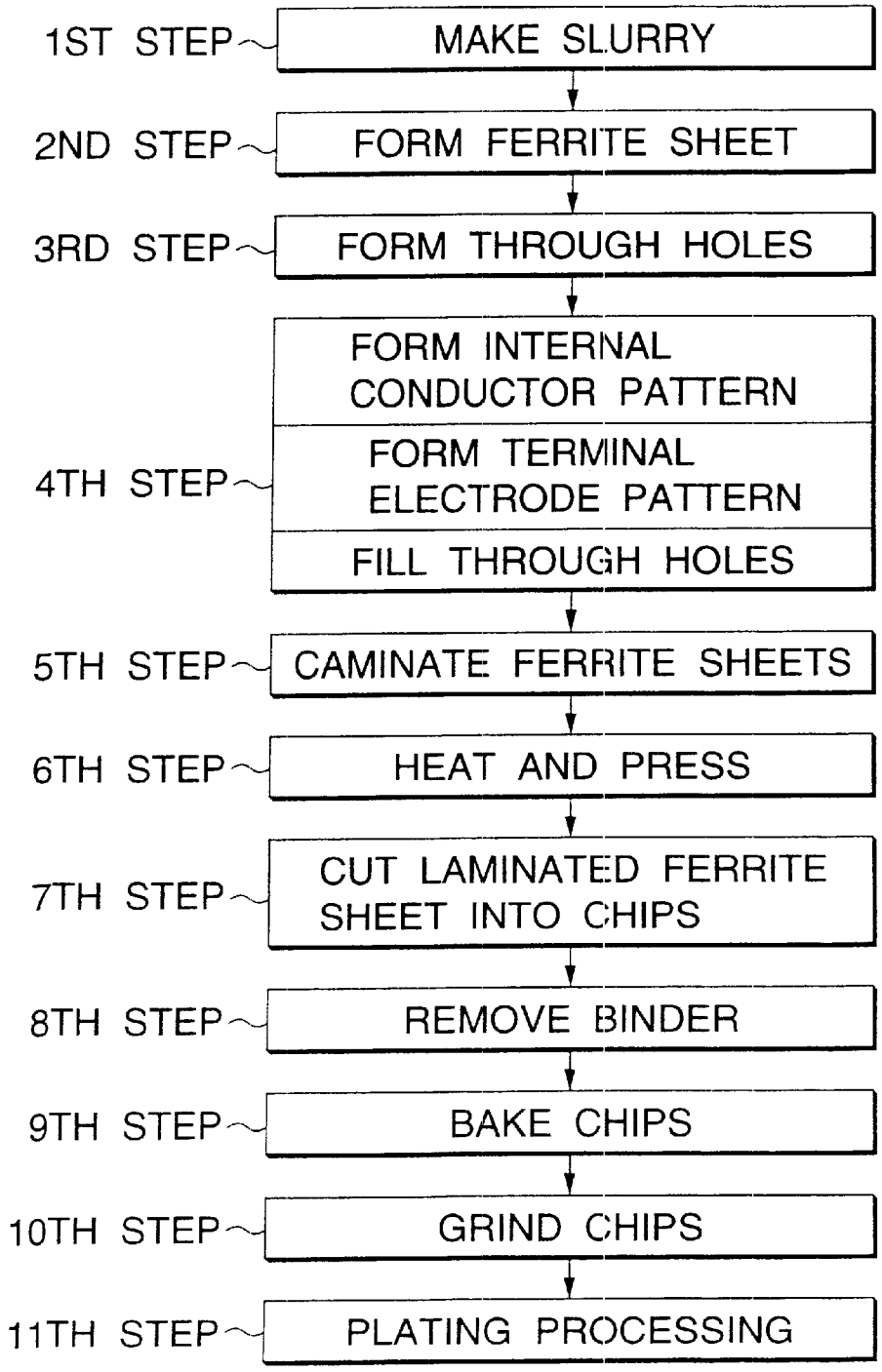
FIG. 2 is a production processing view of the multi-layer ferrite chip inductors of the invention.

Manufacturing method of the multi-layer ferrite chip inductors of the invention will be explained, referring to FIGS. 2 and 3. FIG. 2 is the production processing view of the multi-layer ferrite chip inductors of the invention. FIG. 3 is as mentioned above the perspective view for explaining the production processing view of the multi-layer ferrite chip inductors of the invention.

The 1st process mixes the ferrite powders such as Ni—Cu—Zn base with the binder such as butyral or acrylic base and an organic solvent appropriately selected from toluene, xylene or modified alcohol so as to for a slurry. The slurry may be added with a plasticizer or dispersant if required.

The 2nd process coats the slurry. on a film such as PET by a doctor blade method and dries it to form a ferrite sheet 31 of about 10 to 40 μm.

The 3rd process forms through-holes 34 of around 60 to 150 μm diameter in the ferrite sheet 31 by the machining work, a laser beam machining or others.

The 4th process carries out the screen process printing of patterns 33 of the internal conductors on the ferrite sheets 31 formed with through-holes 34, using the conductor paste composed of metal powders containing silver or silver and palladium so as to provide conductor patterns 33 of about 5 to 30 μm thickness. The through-holes 34 are at this time filled with the conductor paste. The terminal electrode pattern 32 is also formed with the coil shaped internal conductor patterns in the ferrite green sheet 31 by the screen process printing.

Since desirably the tension strength of the terminal electrode 12 is large, it is preferable that the conductor contains 10 wt % or more silicic acid lead based glass frit or silicic acid zinc based glass frit. But too much containing the glass frit, direct current resistance increases and affects bad influence to the characteristic, and therefore preferable is 30 wt % or higher, and more preferable is the conductor containing the glass frit of 20 to 25 wt %.

The 5th process laminates the ferrite sheets 31 printed with the terminal patterns 32 and the ferrite sheets 31 printed with the coil shaped internal conductor patterns 33 in the order as shown in FIG. 3 in the direction where the laminated face of the ferrite sheet 31 is vertical with the element mounting surface.

The 6th process presses the laminated ferrite sheets at temperature of around 40 to 120° C. and pressure of around 500 to 2000 kg/cm$^2$.

The 7th process cuts the heated and pressed laminated ferrite sheets into predetermined sizes to form chip shapes.

The 8th process heats the cut chips until around dissolving temperature and removes the binder.

The 9th process bakes and sinters the chips having removed the binder at around 850 to 920° C. so as to obtain the sintered body.

The 10th process grinds the above baked chips by a method such as a barrel.

The 11th process performs the electrolytic plating on the ground baked body so as to form films such as nickel, tin and others on the surface of the terminal electrode.

Passing the above processes, the multi-layer ferrite chip inductor array is obtained.

According to the production method of the multi-layer ferrite chip inductor array of the invention, since the terminal electrode patterns 32 are formed in the ferrite sheet 31 prior to baking by the screen process printing, deviation from the designed position can be controlled within 10 μm differently from the printing on the sintered element carried out when forming the conventional terminal electrodes. When laminating them, deviation can be controlled within 10 μm. This precision fully satisfies the designing values of the 2010 shape. Since the terminal electrode can be formed at the same time as the internal conductor, the production process can be shortened than the conventional method.

In the laminating process, the conductor pattern between the sheets is electrically connected with the terminal electrode via the conductor filled in the through-hole 34. Therefore, the terminal electrode pattern 32 and the coil shaped internal conductor pattern 33 can be connected by the conductor material filled in the through-hole 34, and the connection between the terminal electrode 12 and the coil shaped internal conductor 13 can be easily formed than the prior art.

Further explanation will be made to examples of the invention.

EXAMPLE 1

The ferrite powder (Ni—Cu—Zn based ferrite), the organic solvent (mixture of toluene, xylene and the modified alcohol), and the binder (butyral) were mixed to make to a slurry. The slurry was cast on the PET film by the doctor blade method so as to obtain the 25 μm ferrite sheet (called as "sheet" hereafter).

The sheet was formed with a plurality of through-holes of 80 μm diameter by the laser beam machining. Subsequently, the conductor pattern corresponding to the coil shaped internal conductor was performed with the screen process printing in this sheet with the conductor paste containing silver. The set chip size was 2.0 mm length, 1.0 mm width and 0.5 mm height, and the film thickness of the conductor when printing and drying was about 8μm. Similarly, the terminal electrode pattern was screen-printed with the conductor paste containing silicic acid lead 20 wt %. The printed thickness at that time was-about 50 μm.

The printed sheets were piled as shown in FIG. 3 in the predetermined order, pressed at 50° C. and 800 g/cm2, cut, treated to remove the binder, and baked to turn out the baked chip already formed with the terminal electrodes. In the baked chip, the thickness of the ferrite layer was 20 μm and the thickness of the internal conductor layer was 6 μm. This element was subjected to the barrel grinding, followed by forming the nickel or tin film by the electrolytic plating treatment, and thus the multi-layer ferrite chip inductor array was obtained. The obtained multi-layer ferrite chip inductor array had the laminating number of 45 layers, coiling number of the internal electrode of 15,5 turns, space between the coils of 200μm, four circuits, and the available impedance of 600 in 100 MHz.

For comparison, prepared was the conventional multi-layer ferrite chip inductor array (impedance, space between the layers, and space between coils were the same as those of the above example, and the coiling number was 9.5 turns such that the impedance was the same as that of the example), and the respective evaluations of deviation from the designing position of the terminal electrode, the cross talk, the stress, the resonance frequency, and the insulating resistance were made together with the multi-layer ferrite chip inductor array of the invention.

Evaluation of Deviation from the Designing Position of the Terminal Electrode The evaluation of deviation from the designing position of the terminal electrode depended on such methods of burying the respective 10 pieces of the elements of the invention and the prior art, grinding them, observing the cross sections thereof by the stereo microscope, and demanding for the distance from the center point of the through-hole contacting the terminal electrode to the center axis of a longer axial direction (c direction) of the terminal electrode. The shorter this distance, the less the deviation from the designing position of the terminal electrode. The results are shown in Table 1. Comparing with the prior art, it is found that the deviation was remarkably improved in the invention.

Evaluation of the Cross Talk

The respective 10 pieces of the elements of the invention and the prior art were evaluated at 30 MHz by combining one circuit of the two circuits of the inside of the coil shaped internal electrodes to the primary side of the network analyzer. The results are shown in Table 1. By the invention, it is found that the cross talk was controlled to be low.

Evaluation of Stress

The respective 10 pieces of the elements of the invention and the prior art were immersed in the soldering chamber at 250° C. for 10 seconds. The impedance before and after the immersion was measured at the amplitude of 0.5 Vrms and the frequency of 100 MHz by using the impedance analyzer, and the stress was evaluated by the difference in values before and after the measuring. The results are shown in Table 1. It is found that variations of the characteristics were remarkably small, and the stress distribution was not complicated in comparison with the prior art element.

Evaluation of the Insulating Resistance

The insulating resistance was evaluated by measuring values of the insulating resistance of the inside two circuits of the respective coil shaped internal conductors with the respective 10 pieces of the elements of the invention and the prior art. The results are shown in Table 1. It is found that the insulating resistance of the inventive element was improved than the conventional element.

TABLE 1

| | Terminal electrode position error (μm) | Cross talk (dB) | Impedance variation caused by soldering (%) | Impedance variation caused by plating (%) | Insulation resistance (Ω) |
|---|---|---|---|---|---|
| Example 1 | | | | | |
| Average | 6.0 | −49.2 | 4.8 | 2.5 | $2.37 \times 10^{10}$ |
| Standard deviation | 2.3 | 1.6 | 1.2 | 1.1 | $0.97 \times 10^{10}$ |
| Comparative example | | | | | |
| Average | 29.4 | −44.0 | 10.3 | 10.8 | $2.53 \times 10^{9}$ |
| Standard deviation | 9.2 | 1.1 | 1.2 | 1.6 | $2.14 \times 10^{9}$ |

Sample number n = 10

Evaluation of Resonance Frequency

Figure 4:
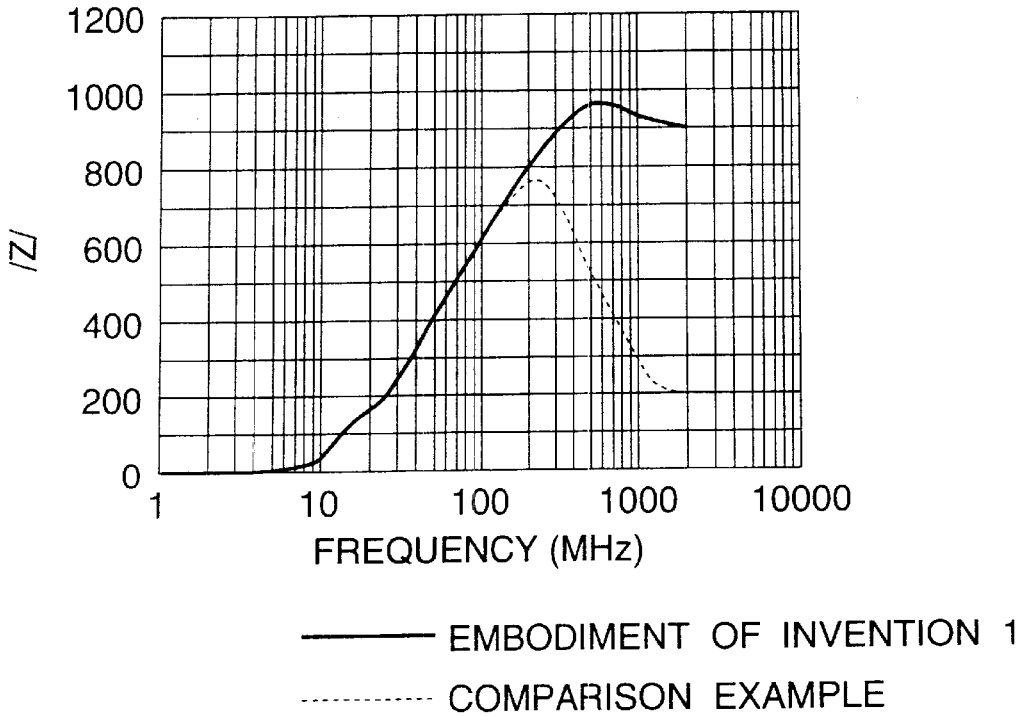
FIG. 4 is a graph showing difference in the frequency characteristics of the multi-layer ferrite chip inductor arrays of the invention and the prior art.
Figure 5:
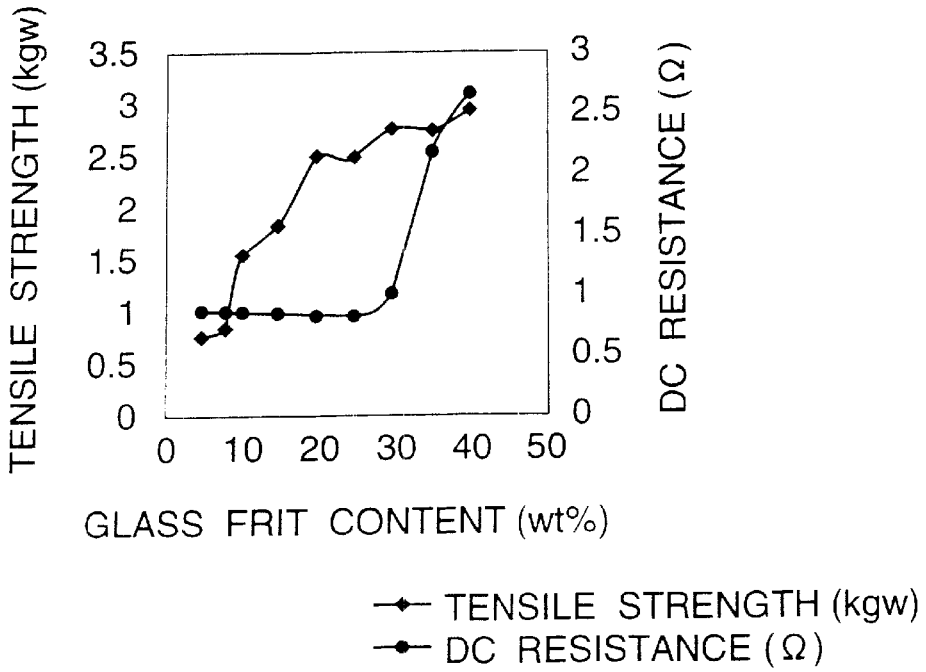
FIG. 5 is a graph showing variances in the tension strength and the direct current resistance value with respect to the glass frit containing amount of the terminal electrode.

The evaluation of resonance frequency was performed by measuring the resonance frequency by the impedance analyzer. The results are shown in FIG. 4. The axis of abscissa is the frequency and the axis of ordinate is the impedance value. From FIG. 4, it is found that the resonance frequency of the element of the invention considerably extends toward the high frequency in comparison with the prior art element. This means that the stray capacity is less in the positional relation between the coil shaped internal conductor and the terminal conductor.

Example 2

For knowing the proper amount of the glass frit to be contained in the terminal conductor, the samples of the multi-layer ferrite chip inductor array where the glass frit containing amount was changed, were made in the same manner as the example 1. The sample was soldered at a couple of both ends with the tin plated lead wires, and pulled, and the strength (tension strength) when being exfoliated was measured. The results are shown in Table 2 and FIG. 4. From Table 2 and FIG. 4, it is found that the containing amount of the glass frit increased and the tension strength heightened. But if exceeding a certain amount, it is found that the direct current resistance value increased and affected bad influences to the characteristics. The terminal strength is required to be 1 kgw or higher, and around 2 kgw is desirable. As to the direct current resistance value, being low to the utmost is preferable. Accordingly, in the containing amount of the glass frit, 10 to 30 wt % is referable, and more preferable is 20 to 25 wt %.

TABLE 2

| Glass frit content (wt %) | Tensile strength (kqw) | DC resistance (Ω) |
|---|---|---|
| 5 | 0.7 | 0.8 |
| 8 | 0.8 | 0.8 |
| 10 | 1.5 | 0.8 |
| 15 | 1.8 | 0.8 |
| 20 | 2.5 | 0.8 |
| 25 | 2.5 | 0.8 |
| 30 | 2.8 | 1.0 |
| 35 | 2.8 | 2.2 |
| 40 | 3.0 | 2.7 |

According to the invention, it is possible to provide the small sized multi-layer ferrite chip inductor arrays of highly sizing precision and high characteristics as well as a production method thereof, whereby the terminal electrode is fabricated with high precision, enabling to check influences by stress of the ferrite layer and by the plating treatment, with less cross talk, high self resonance frequency, little deterioration of insulating

What is claimed is:

1. A multi-layer ferrite chip inductor array comprising:

an integrated circuit comprising an element main body, said element main body comprising an interior and an element mounting surface;

a plurality of terminal connectors arranged around a periphery of said element main body;

a plurality of inductors located in said interior of said element main body;

each of said inductors comprising a plurality of layers laminated together;

laminated faces of each of said plurality of layers being perpendicular to said element mounting surface;

said plurality of layers comprising a plurality of ferrite layers and a plurality of conductor layers;

said plurality of ferrite layers having through-holes formed therein;

each said conductor layer comprising at least one internal conductor;

a plurality of said conductors being configured to form coils having a coiling direction;

said coiling direction of said coils being parallel to said element mounting surface;

each of said inductors comprising a first end provided with a first terminal electrode and a second end provided with a second terminal electrode;

said first terminal electrode and said second terminal electrode each being electrically connected to one of said terminal connectors by filling said through-holes formed in said plurality of ferrite layers.

2. The ferrite chip inductor array as claimed in claim 1, wherein said first and second terminal electrodes comprise an electrically conductive material containing glass frit in a range of 10 wt % to 30 wt %.

* * * * *